United States Patent [19]

Schreiber

[11] 3,973,156

[45] Aug. 3, 1976

[54] ANODE DISC FOR AN X-RAY TUBE COMPRISING A ROTARY ANODE

[75] Inventor: Peter Schreiber, Halstenbek, Germany

[73] Assignee: U.S. Philips Corporation, New York, N.Y.

[22] Filed: Dec. 27, 1974

[21] Appl. No.: 536,837

[30] Foreign Application Priority Data

Jan. 23, 1974 Germany ..... 2403015
Feb. 5, 1974 Germany ..... 2405334

[52] U.S. Cl. ..... 313/330; 313/60
[51] Int. Cl.[2] ..... H01J 35/08
[58] Field of Search ..... 313/330, 60

[56] References Cited

UNITED STATES PATENTS

| | | | |
|---|---|---|---|
| 2,935,633 | 5/1960 | Peters | 313/330 X |
| 3,546,511 | 12/1970 | Shimula | 313/60 |
| 3,751,702 | 8/1973 | Dietz | 313/330 |
| 3,795,832 | 3/1974 | Holland | 313/330 |
| 3,836,803 | 9/1974 | Dietz et al. | 313/330 |
| 3,836,804 | 9/1974 | Frens et al. | 313/330 |

*Primary Examiner*—Saxfield Chatmon, Jr.
*Attorney, Agent, or Firm*—Frank R. Trifari; George B. Berka

[57] ABSTRACT

A one-piece anode disc for a rotary anode X-ray tube is provided with a groove in the immediate vicinity of each side of the focal path to reduce thermal stresses in the path.

2 Claims, 2 Drawing Figures

ANODE DISC FOR AN X-RAY TUBE COMPRISING A ROTARY ANODE

Figure 1:
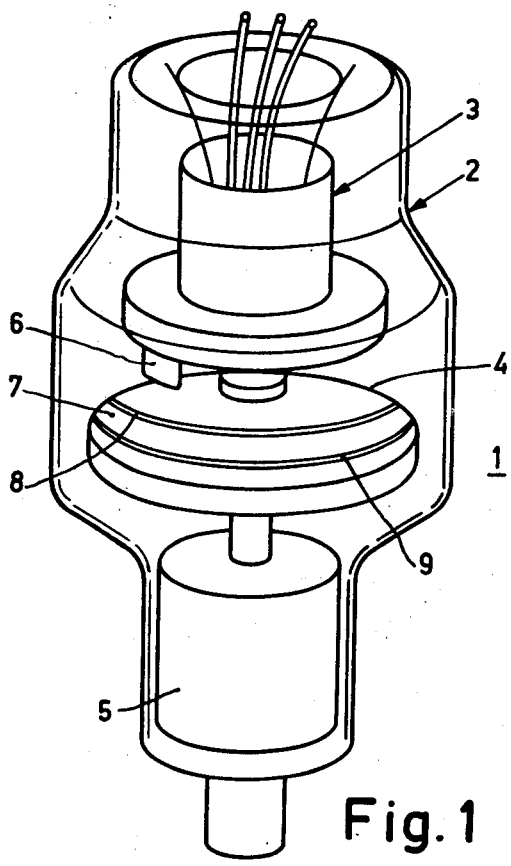

The invention relates to a rotary-anode X-ray tube comprising at least one groove which is provided on the target side so as to be concentric with respect to the focal path. The thermomechanical stresses ocurring in high-power rotary-anode X-ray tubes during exposures often cause cracks in the anode discs. This occurs notably when previously prolonged exposures or series exposures have been made, and the anode has meanwhile cooled down.

This tendency to crack can be eliminated in various ways. For example, it is known the tendency to crack is reduced when the anode is heated to a temperature of about 400°C prior to an exposure, because the anode material is more ductile at this temperature. In order to heat the anode to this temperature, the X-ray tube should operate at low power prior to an exposure. Because this heating up procedure interferes with the actual examination practice, preheating is not applied in practice.

From German Offenlegungsschrift No. 2,252,291 it is known to provide the anode disc with a number of radially extending grooves which, departing from the edge, intersect the focal path. The manufacture of such grooves which, moreover, should tend to extend in the direction of the axis of rotation of the anode disc in order not to let the electrons pass the groove, is rather complex because the materials commonly used for a rotary anode (tungsten, molybdenum, graphite or alloys thereof) are difficult to machine. It is a further drawback that the X-radiation is modulated by the groove during an exposure. In addition, during fluoroscopy, when the anode is stationary, the uniform distribution of the heat in the anode is hampered by the grooves, with the result that the anode segment present in the beam path during fluoroscopy is liable to be overheated in given circumstances.

From German Offenlegungsschrift No. 1,937,351 it is furthermore known to reduce the tendency to crack of an anode for a rotary-anode X-ray tube by providing the anode with recesses between the inner edge of the focal path and the axis of rotation in order to obtain resilient properties, the said recesses interrupting the direct radial connection between axis and focal path. FIGS. 8*a* and 8*b* of the latter publication show an anode disc where the focal path is embedded in the basic body in the form of a thin metal ring. On the upper side and the lower side of the part of the anode disc situated between the axis of rotation and the focal path there are provided annular recesses which have been shifted with respect to each other. Any bending stresses occurring are taken up in that the grooves on the top close slightly and the grooves at the bottom widen slightly. Such closely adjoining and overlapping grooves can be manufactured only with great difficulty. Because bending stresses can generally give rise to cracking only in anode discs having a basic body which is made of graphite, such grooves represent substantially no technical improvement for normal anode discs having a basic body made of molybdenum, tungsten or an alloy thereof. Moreover, the closely adjoining grooves hamper the transfer of heat from the focal path towards the centre of the disc, so that such discs cannot be loaded by the same power as discs having the same disc mass but no grooves.

The invention has for its object to provide an anode for a rotary anode X-ray tube which can be readily manufactured and which comprises a disc which is protected from cracking, without the heat transfer or the strength being substantially reduced.

To this end, an anode disc of the kind set forth is characterized in that the groove is situated in the immediate vicinity of the focal path.

The invention and its advantages will be described in detail hereinafter with reference to an embodiment which is diagrammatically shown in the drawing.

Figure 2:
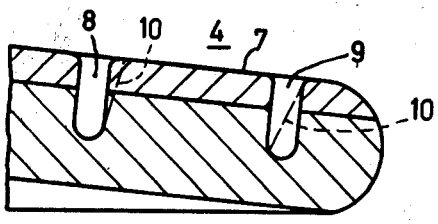

FIG. 1 shows a rotary-anode X-ray tube comprising an anode disc according to the invention, and FIG. 2 is a cross-sectional view at a substantially increased scale of the region of the focal path in an anode disc according to the invention.

FIG. 1 shows a rotary-anode X-ray tube 1 whose vacuum glass envelope 2 accommodates a cathode carrier 3 and an anode disc 4 which is arranged on a rotor 5. The actual cathode filament is situated in a cap connected to the cathode carrier 3. Therebelow, a focal path 7 is situated on the anode disc, Rotary-anode X-ray tubes of this kind are generally known, so they need not be further described herein.

According to the invention, the focal path 7 is bounded on the inner side and the outer side by concentric grooves 8 and 9, respectively. During an exposure, the focal path is substantially heated. Because grooves are provided at both its edges, it can expand substantially without limitation in the radial direction, i.e. it can become wider. The path can also expand in the tangential direction under the influence of the heating, which means that its diameter can increase. The change denoted by broken lines in FIG. 2 then takes place, the inner wall of the outer groove then being moved further outwards than the outer wall of the inner groove 8. Because the focal path, when heated, can thus become wider substantially without limitation and because its diameter can increase, only low stresses occur in the focal path in the tangential and the radial direction. The grooves on both sides of the focal path also ensure that the parts of the anode surface adjacent the focal path are heated less during the exposure, so that the thermal stresses occuring are also lower at these areas.

The thermal stresses in the radial and the tangential direction will be more effectively reduced as the grooves on both sides of the focal path are deeper. However, the grooves cannot be arbitrarily deep, because this has an adverse effect on the strength and the thermal behaviour of the anode after the exposure. Therefore, the depth of the grooves should in no case exceed 90% of the thickness of the anode disc. Tests performed on a 100-kW X-ray tube gave very good results with grooves having a depth of approximately 1.5 mm and about the same width provided on both sides of the focal path. The relevant anode material consisted of, for example, molybdenum covered with a tungsten-rhenium layer; the thickness of the anode disc was 7 mm and the width of the focal path was 12 mm.

The grooves should be provided as near to the focal path as possible. This offers the advantage that the effective focus for the X-ray beam is well defined on at least two sides. If the distance between the focal path and the groove is larger than half the width of the focal path, the grooves have substantially no effect.

The width of a groove may amount to 0.2 mm and more. A groove which is much too wide, however, has an adverse effect on the strength of the anode disc, notably if this groove encloses the focal path. The grooves should be rounded at the bottom - as shown - in order to prevent notches. It is also advantageous to widen the grooves wedge-like on the target side, because at this area the highest temperatures occur and hence also the most significant expansions and shifts.

The slight reduction of the heat discharge in the radial direction - determined by the grooves - is not disturbing, because in the case of substantially loaded foci (a width of the focal path in excess of 5 mm) the heat is initially discharged mainly in the axial direction. In the case of foci for smaller powers - a smaller width of the focal path - where the heat discharge in the radial direction is also important, there will be no cracks in the anode disc. Cracks which appear in the focal path in spite of the reduced thermal stresses and which continue to the edge of the anode disc in the course of time in anode discs not provided with grooves, cannot extend as far as the edge because of the presence of the outer groove, so that the tendency to crack of the anode disc is reduced. Therefore, in special cases it is sufficient to provide only one groove which encloses the focal path. An anode disc which comprises only one groove, enclosed by the focal path, already shows a reduced tendency to crack. The best results, however, are obtained using anode discs provided with grooves on both sides of the focal path.

The invention can be used for all known anode materials, for example, for single discs where the entire anode disc is made of tungsten, a tungsten alloy or molybdenum, for composite discs where, as denoted in the drawing by a different direction of the lines, the basic body is made of a molybdenum alloy or of graphite, provided with a cover layer of an X-ray emissive material such as tungsten or a tungsten alloy or molybdenum.

What is claimed is:

1. An anode for a rotary anode X-ray tube, comprising a one-piece disc defining on a surface portion thereof an annular focal path, and a pair of annular grooves provided in said disc in proximity to and concentrically with respective sides of said path.

2. An anode as claimed in claim 1, wherein the distance between the grooves is smaller than the width of the focal path.

* * * * *